United States Patent [19]

Davis

[11] Patent Number: 5,048,215

[45] Date of Patent: Sep. 17, 1991

[54] FRONT GRIP FOR A FIREARM

[75] Inventor: James C. Davis, Bakersfield, Calif.

[73] Assignee: Calico Light Weapon Systems, Bakersfield, Calif.

[21] Appl. No.: 575,438

[22] Filed: Aug. 30, 1990

[51] Int. Cl.[5] ..... F41C 23/16; F41C 23/22

[52] U.S. Cl. ..... 42/72; 42/71.01; 42/73

[58] Field of Search ..... 42/71.01, 72, 73

[56] References Cited

U.S. PATENT DOCUMENTS

| | | | |
|---|---|---|---|
| 50,312 | 10/1865 | Charlesworth . | |
| 63,303 | 3/1867 | Rastell . | |
| 445,192 | 1/1891 | Nye et al. . | |
| 809,080 | 1/1906 | Wight . | |
| 897,577 | 9/1908 | Bourne . | |
| 898,178 | 8/1907 | Bourne . | |
| 1,278,027 | 9/1918 | Saunders | 42/71.01 |
| 1,357,208 | 5/1919 | Payne . | |
| 1,363,809 | 12/1920 | Payne | 42/72 |
| 1,585,249 | 5/1926 | Johns . | |
| 1,695,071 | 12/1928 | Villalpando | 42/72 |
| 2,109,993 | 5/1937 | Furst . | |
| 2,435,217 | 2/1948 | Howell, Jr. | 42/72 |
| 2,547,180 | 4/1951 | Taylor | 42/72 |
| 2,771,697 | 8/1953 | Reising . | |
| 2,782,545 | 9/1954 | Schadeck . | |
| 2,826,848 | 3/1958 | Davies . | |
| 2,933,843 | 4/1960 | McFeeter . | |
| 2,965,994 | 5/1957 | Sullivan . | |
| 3,075,314 | 1/1963 | Bakker . | |
| 3,090,150 | 5/1963 | Stoner | 42/71.01 |
| 3,164,920 | 1/1965 | Haas, Jr. et al. . | |
| 3,256,632 | 6/1966 | Beretta | 42/72 |
| 3,623,257 | 6/1969 | Ray . | |
| 4,282,671 | 8/1981 | Wood et al. . | |
| 4,502,238 | 3/1985 | Farrar et al. . | |
| 4,759,145 | 7/1988 | Volansky | 42/71.01 |
| 4,932,148 | 6/1990 | Barrett | 42/71.01 |

*Primary Examiner*—Charles T. Jordan
*Assistant Examiner*—Richard W. Wendtland
*Attorney, Agent, or Firm*—Roylance, Abrams, Berdo & Goodman

[57] ABSTRACT

An optional removable front grip usable with any firearm having a barrel shroud formed with a row of regularly spaced openings on its underside. Such openings are routinely provided to ventilate the barrel. The invention front grip is hollow and is provided with a set of lugs which engage any three adjacent barrel shroud ventilation openings to thereby accommodate shooters having different arm lengths. One of the lugs is a locking lug which is operated easily by a screwdriver inserted through the hollow grip.

6 Claims, 2 Drawing Sheets

FIG. 1
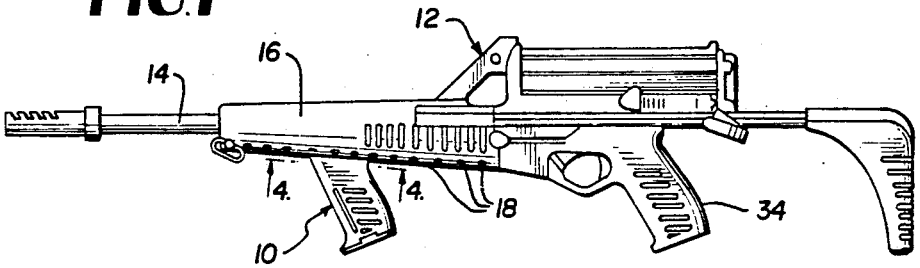
FIG. 2
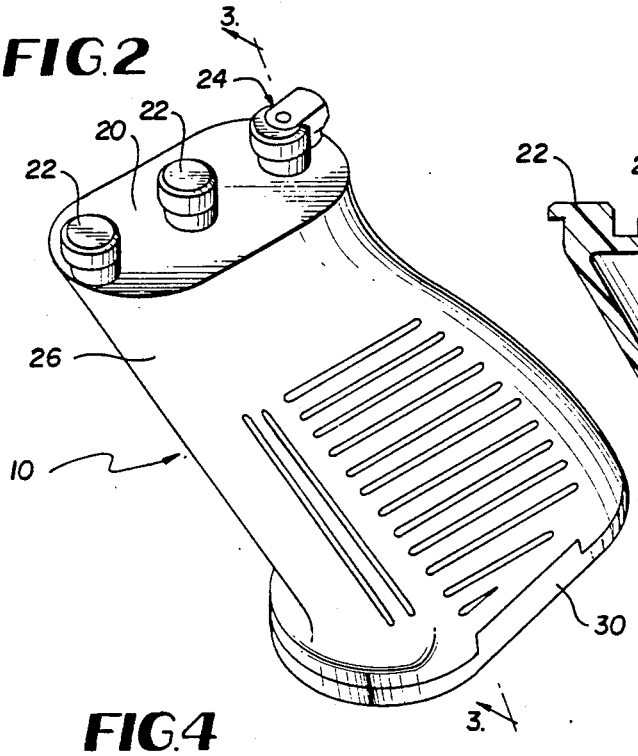
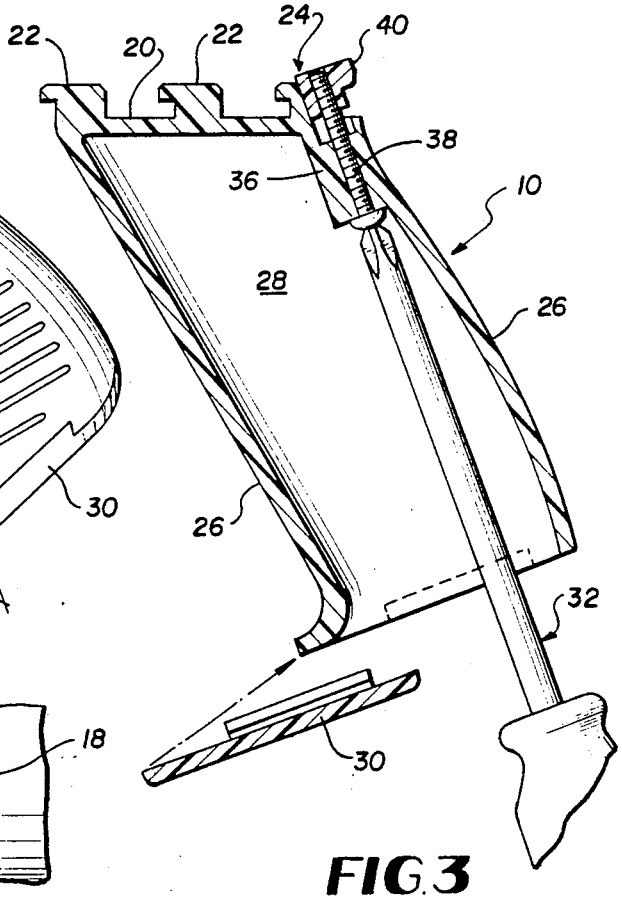
FIG. 3
FIG. 4
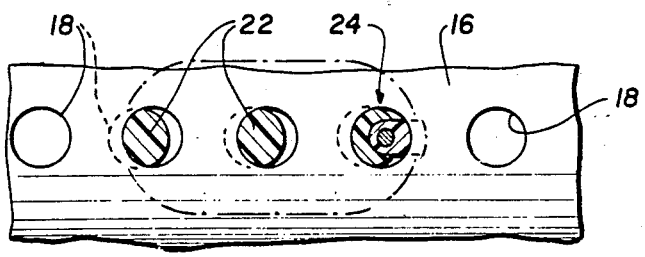
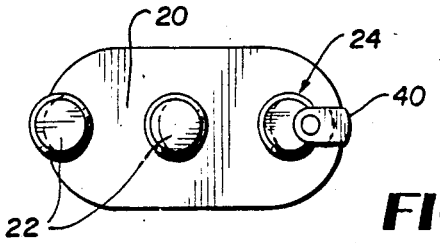
FIG. 5

FIG. 6
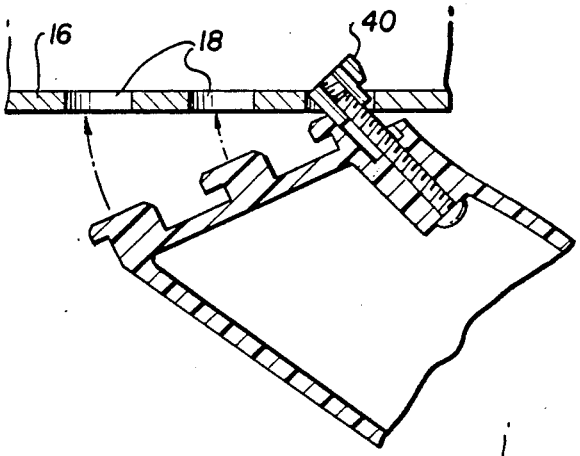
FIG. 7
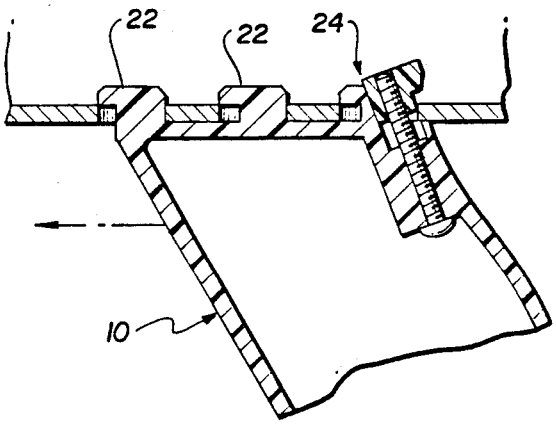
FIG. 8
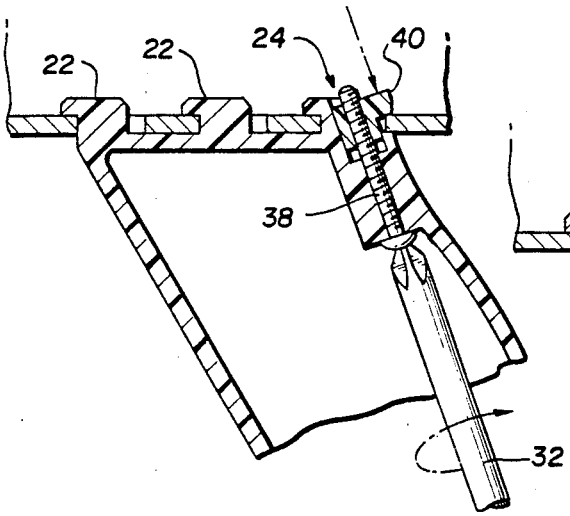
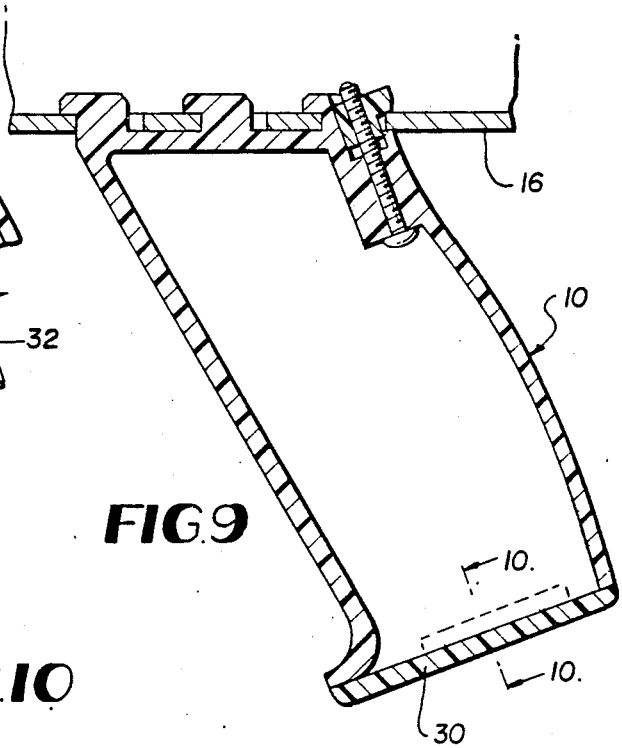
FIG. 9
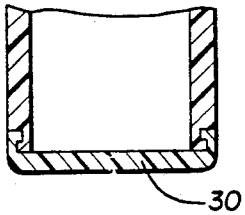
FIG. 10

FRONT GRIP FOR A FIREARM

FIELD OF THE INVENTION

This invention pertains to firearms. More in particular, it pertains to long guns, such as rifles, carbines, and the like, as opposed to pistols. Still more in particular, it pertains to a front grip which may be optionally mounted on certain types of such guns.

ENVIRONMENT OF THE INVENTION

The invention is applicable for use with only a particular type of such gun. This type is that which includes a shroud or forearm on the barrel forward of the operating mechanism. Frequently, these barrel shrouds are provided with a plurality of ventilation openings formed along their length. The invention optional front grip utilizes these barrel shroud openings.

Different weapons have different shapes of openings positioned at different spacings on such barrel shrouds. Thus, when used with any particular weapon, the invention front grip will have to be proportioned so as to accommodate the size and spacing of the particular barrel shroud openings in a particular weapon for which it is designed. This is a more or less trivial matter. The net effect is that each embodiment of the invention will be, in general, custom designed for a particular weapon. However, the feature, a ventilated barrel shroud having a longitudinal row of openings along its bottom surface is very common. For this reason, the invention is applicable to a large number of weapons, even though each particular front grip must necessarily be sized and proportioned for each particular weapon.

FEATURES AND ADVANTAGES OF THE INVENTION

Overall, the invention provides an optional adjustable front grip for such guns. It is advantageous for the invention that it is both optional and adjustable.

Some shooters prefer to grip the barrel shroud itself Thus, they do not want a front grip at all. The present invention would thus find no market with persons of that preference. Other shooters, and perhaps the larger number, do prefer a front grip, for numerous reasons set forth below. However, since people come in many different "sizes", and these differences include the lengths of their arms, it is desirable to have a front grip which is adjustable along the length of the weapon. The invention provides such a grip.

Another advantage of the invention is the design of the handle itself. It is built with a downward and rearward angle to it. This facilitates use of a conventional screwdriver to get access to the adjustable lug to permit mounting and dismounting of the invention handle from the cooperating gun. In addition, this angle is popularly used at present, and thus, matches the other gripping portions of the gun to improve the appearance of the gun when the invention optional handle is provided.

The invention is usable equally well by left-handed and right-handed shooters. This is an important advantage of the invention, for obvious reasons.

A front grip is often desired because it helps to aim the gun, and it helps the user to support the weight of the gun in a more comfortable position. Further, the front grip allows swinging of the muzzle of the gun around using strong muscles of the arm that would not be used if the weapon were held with the palm up, as it would be when gripping the barrel shroud itself. That is, the invention grip allows it to be grasped in a thumb up or fist-like position. In this position, the elbow can be used for maneuvering. In the palm up position, the maneuvering must be done from the shoulder and the elbow is in effect locked Thus, in general, a front grip held in a fist is more desirable than a palm up posture wherein use of the elbow is lost.

Another advantage of a front grip is that it allows better aiming and better weight support, because the user can more efficiently draw the weapon back hard against his shoulder and hold it there firmly during aiming and firing. This has an obvious improvement on accuracy and fatigue.

Another group of advantages of the invention have to do with its interaction with the weapon. The invention grip does not interfere with any of the operating parts of the gun, does not add materially to its weight, does not tend to unbalance the weight distribution of the gun, and does not negatively effect, and to some people it even positively effects, the appearance of a gun fitted with the invention optional front grip.

Another feature and advantage of the invention is the manner of manufacture of the invention front grip. It is preferably fabricated from plastic using mass production molding techniques, having only a single moving part. In this manner, a durable front grip is provided at relatively low cost.

Another advantage of the invention is that it is very simple to install or to remove from a gun. A single screw is all that needs to be manipulated for such mounting or dismounting.

Yet another feature of the invention has to do with the optional front grip serving as a storage means. The grip is hollow and it has a removable plate at its lower end. Upon opening or removing this lower end plate, a space is provided in which cleaning tools, or other miscellaneous small items may be stored. This is a convenience for the user.

Another feature of the invention is that the front grip can be used as a support when the weapon is fired from the prone position. That is, the front grip can be rested directed on the ground when the shooter is in a prone position.

Another advantage of front grips in general is that it permits the shooter to absorb the recoil energy of the gun in both arms more efficiently than he could do if holding the front of the weapon in his palm by the barrel shroud only.

SUMMARY OF THE INVENTION

The invention provides a removable optional front grip for use with guns having a particular type of barrel shroud, namely, one which is formed with a longitudinal row of openings in the bottom surface. The invention grip is designed to cooperate with three adjacent openings in this row of openings, to thereby provide a secure adjusted position of the front grip with respect to the weapon to thereby accommodate users having different arm lengths.

The front grip of the invention is primarily a one piece molded device. It has a hollow body which is closed off by a plate at the lower end. The space within the body is usable for storage, and also provides access to the rearmost of the three attachment lugs. This rear attachment lug is controlled by a screw operated from the inside of the handle by an ordinary screwdriver.

In use of the invention front grip, the rear adjustable lug is first fitted into the rearmost of the three openings which will be used in the barrel shroud. Then the other lugs are rotated upwardly around that rear lug until they fit into adjacent ones of the barrel shroud openings. Finally, after all three lugs are in position in their three holes, the grip is slid forward. Then, a screwdriver is used through the inside of the hollow handle to tighten the rear lug. The grip is then securely fastened to these three holes in the barrel shroud Disassembly is simply the above steps performed in reverse; first the single screw is loosened, then the grip slid rearwardly, and then it is rotated out of position and removed from the gun.

In this manner, the invention provides a removable front grip which is easily adjusted for different size persons using the gun; and which can be manufactured to fit a wide variety of guns, in fact all guns having a ventilated barrel shroud wherein, the ventilation is provided by a row of openings along the bottom of the shroud. Still further, the invention provides such a grip which is simple in design and readily adaptable to mass production at relatively low cost. The invention grip is very simple to mount and dismount and is highly reliable and efficient in operation. Finally, the invention provides a thumbs up or fist grasp for the invention front grip, which arrangement has numerous advantages as set forth above.

The invention will be best understood from a careful reading of the following detailed description taken in conjunction with the enclosed drawings, which drawings form a part of this disclosure, and in which:

BRIEF DESCRIPTION OF THE FIGURES OF THE DRAWINGS

FIG. 1 is a side elevational view of a typical weapon with which the invention front grip can be used;

FIG. 2 is a top front perspective view of a preferred embodiment of the invention grip;

FIG. 3 is a vertical longitudinal cross-sectional view taken generally on line 3—3 of FIG. 2;

FIG. 4 is a cross-sectional view looking on line 4—4 of FIG. 1 with certain parts omitted for the sake of clarity;

FIG. 5 is a top view of the front grip looking from the upper side of FIG. 2;

FIGS. 6–9 are a series of "action" drawings showing the manner of mounting and dismounting of the invention grip on a firearm; and FIG. 10 is a cross-sectional view of a detail taken on line 10—10 of FIG. 9.

DETAILED DESCRIPTION OF THE PREFERRED EMBODIMENT

Referring now in detail to the drawings, in FIG. 1 there is shown a front grip 10 mounted on a weapon 12 which is representative of a large class of weapons with which the invention can be used. Gun 12 shown is of a design which is owned in common the present invention.

Gun 12, representative of its class, includes a barrel 14 and a barrel shroud 16. The shroud 16 is provided to protect the user's front hand holding the weapon from the heat generated in the barrel in use.

The feature about barrel shroud 16 which is important for the invention is a row of openings 18 formed at regularly spaced intervals over its entire length. The showing of FIG. 1 has been distorted by putting the openings 18 to one side, where they are visible in the drawing. In fact, the openings 18 are provided along the bottom surface axially aligned with the vertical plane of the gun. Reference should be had to FIG. 4 to see the accurate positioning of the openings 18.

Referring now to FIGS. 2 and 3, the invention grip is shown in some detail. It is basically of a conventional handle-like shape, adapted to be gripped in a fist in a thumbs up posture. It is formed with a top wall 20 formed with a pair of fixed locking lugs 22. A third adjustable locking lug 24 is provided. The spacing between the three lugs 22, 22 and 24 is such as to match the spacing of the openings 18 in the barrel shroud 16. Each lug 22, 22 and 24 includes a front hook portion, see FIG. 3, for a purpose described below.

Extending downwardly from all sides of the top wall 20 is a main body wall 26 which defines an internal cavity 28. Finally, the handle of the invention 10 includes a bottom removable door or lid 30. The lid is shown in a closed position in FIGS. 2, 9 and 10, and in a removed position in FIG. 3. The lid is removed so that access by a screwdriver 32 to the adjustable lug assembly 24 can be had through the space 28 in handle 10. Also, this space is usable for storing cleaning materials, spare parts, ear plugs, or other miscellaneous items.

As shown in FIGS. 1 and 2, the main wall 26 can be provided with numerous design features, grip enhancing ridges, trademarks, names, data, and the like. Further, the handle 10 is preferably made in such a manner that it matches the fixed rear grip 34 forming part of weapon 12, see FIG. 1.

The adjustable lug assembly comprises an enlarged boss portion 36 formed on the inside rear corner at the junction of the top wall 20 and the main wall 26. A through opening is formed in which is fitted a single screw 38. The screw cooperates with a threaded opening in a movable locking lug portion 40 forming the rear part of the rear lug assembly 24. The remaining portion of the rear lug assembly 24 comprises an extending lip portion which matches exactly the forward portions of the other two fixed lugs 22. This is shown clearly in FIGS. 2 and 3, especially FIG. 3

As can be seen, the invention handle is simple and easy to manufacture. The walls 20 and 26 together with the lugs 22 and the front part of lug assembly 24 can be molded all in one piece of a durable high impact plastic suitable for use in firearms. The remaining parts of the grip are the bottom lid 30, the screw 38, and the movable lug portion 40. Thus, the invention can be manufactured at relatively low cost, and be made to be quite durable and highly reliable in use.

Further in regard to the lid 30, one manner in which it can be secured to the bottom end of the handle is illustrated in FIG. 10. This is the successfully constructed embodiment, but other arrangements, well known to those skilled in the art, can also be provided.

For example as to other arrangements, the invention could be used with a barrel shroud having a large number of relatively small ventilation holes, or with an arrangement of alternating large and small holes. In such cases, simple changes to accommodate would be made in the invention grip, i.e., use every other hole, or use lugs of different sizes, or use 2 or 4 lugs, or use more lugs, or provide more locking lugs, etc.

The manner of operation of the invention will be best understood from a review of the remaining FIGS. 4-9, together with the following description.

Referring first to FIG. 6, the movable lug part 40 has been moved to the outer end of the screw 38 and has been inserted in the rearmost of a set of three of the holes 18 in the shroud 16. Then, as indicated in the motion between FIGS. 6 and 7, the fixed two lugs 22 are rotated up into the two forwardly adjacent openings 18 in the shroud 16. Then, the handle assembly 10 is slid forwardly so that the hock parts of the three lugs 22 and 24 grasp the forward portions of their three respective openings 18. This is indicated by the arrow in FIG. 7. Then, using the screwdriver 32, and screw 38 is operated to bring lug part 40 down into tight locking engagement with the rear portion of its opening 18. At this point, the handle is securely locked in position on the shroud. It cannot move forward or backward due to the three lugs 22 and 24. The locking action is indicated by the arrow in FIG. 8. FIG. 9 shows the lid 30 put back in place on the bottom of the handle 10, thus completing the mounting procedure.

To dismount the handle, the action indicated by FIGS. 6, 7, 8 and 9 are performed in reverse.

FIG. 4 shows the holes 18 in phantom view as they are engaged with the three lugs 22 and 24. FIG. 5 shows a top plan view of the handle 10 with the three lugs clearly visible.

While the invention has been described in detail above, it is to be understood that this detailed description is by way of example only, and the protection granted is to be limited only within the spirit of the invention and the scope of the following claims.

I claim:

1. A removable optional front grip for a gun, said gun having a barrel and a barrel shroud, said barrel shroud being formed with a row of regularly spaced openings along it's bottom extending longitudinally of said gun, the improvement of said grip comprising a top wall, a plurality lug means on said top wall, one of said lug means having a manually operable locking portion, the spacing of said plurality of lug means matching the regular spacing of said row of openings in said barrel shroud, whereby said front grip may be removably and optionally mounted on said barrel shroud with the use of a plurality of said barrel shroud openings equal in number to said plurality of lug means, and said plurality of lug means being less than the number of said openings in said row of barrel shroud openings, whereby said grip may be mounted at any one of several different positions on said barrel shroud to accommodate different arm lengths of users of said gun.

2. The grip of claim 1, said plurality of lug means comprising three of said lug means, two of said lug means comprising fixed lug means and the third lug means comprising said manually operable locking portion.

3. The grip of claim 1, each of said lug means comprising a hook portion adapted to removably grasp a portion of the cooperating opening of said row of barrel shroud openings.

4. The grip of claim 1, said grip being hollow and having a sloped configuration extending downwardly and rearwardly with respect to said gun, said one of said lug means having said locking portion being the rearmost one of said plurality of lug means, said hollow grip being open at its lower end furthest from said lug means, whereby said movable locking portion may be readily reached and operated by a tool inserted through said open lower end hollow grip to a portion of said locking portion located inside said hollow grip.

5. The grip of claim 1, each of said lug means being formed with a hook portion, said lug means formed with said locking portion being arranged with said hook portion and said locking portion facing in opposite directions longitudinally of said gun, and the parts being so arranged that said grip is mounted on said barrel shroud openings by first engaging said locking portion with one of said barrel shroud openings and then pivoting said grip about said locking portion to engage the remaining ones of said lug means with others of said barrel shroud openings, then engaging said hook portions of all of said lug means with their cooperating barrel shroud openings, and then operating said locking portion to removably secure said grip to said barrel shroud openings.

6. The grip of claim 2, each of said lug means comprising a hook portion adapted to removably grasp a portion of the cooperating opening of said row of barrel shroud openings, said grip being hollow and having a sloped configuration extending downwardly and rearwardly with respect to said gun, and said lug means having said locking portion being the rearmost one of said plurality of lug means, said hollow grip being open at its lower end furthest from said lug means, whereby said locking portion may be reached and operated by a tool inserted through said open lower end of said hollow grip to a portion of said locking portion located inside said grip, said lug means formed with said locking portion being arranged with said hook portion and said locking portion facing in opposite directions longitudinally of said gun, and the parts being so arranged that said grip is mounted on said barrel shroud openings by first engaging said locking portion with one of said barrel shroud openings and then pivoting said grip about said locking portion to engage the remaining ones of said lug means with others of said barrel shroud openings, then engaging said hook portions of all of said lug means with their cooperating barrel shroud openings, and then operating said locking portion to removably secure said grip to said barrel shroud openings.

* * * * *

UNITED STATES PATENT AND TRADEMARK OFFICE

CERTIFICATE OF CORRECTION

PATENT NO. : 5,048,215

DATED : September 17, 1991

INVENTOR(S) : James Clifford David

It is certified that error appears in the above-indentified patent and that said Letters Patent is hereby corrected as shown below:

On the title page, item (75) Inventor's name should read --David--.

Signed and Sealed this

Ninth Day of November, 1993

Bruce Lehman

*Attest:*

BRUCE LEHMAN

*Attesting Officer*

*Commissioner of Patents and Trademarks*